United States Patent [19]

Kelso

[11] 4,087,088

[45] May 2, 1978

[54] MOVING ARTIFICIAL SKI SURFACE CONSTRUCTION

[76] Inventor: Kenneth J. Kelso, P.O. Box 37222, Houston, Tex. 77036

[21] Appl. No.: 726,167

[22] Filed: Sep. 24, 1976

[51] Int. Cl.[2] ..... A63G 21/14

[52] U.S. Cl. ..... 272/56.5 SS; 198/321

[58] Field of Search ..... 272/56.5 SS, 56.5 R, 272/97, 69; 198/841

[56] References Cited

U.S. PATENT DOCUMENTS

| | | | |
|---|---|---|---|
| 3,047,291 | 7/1962 | Hall | 272/56.5 R |
| 3,120,385 | 2/1964 | Hall | 272/56.5 SS |
| 3,224,763 | 12/1965 | Hall | 272/56.5 SS |
| 3,422,732 | 1/1969 | York | 272/56.5 SS |
| 3,689,066 | 9/1972 | Hagen | 272/69 |
| 3,703,284 | 11/1972 | Hesen | 272/69 |

*Primary Examiner*—Richard C. Pinkham
*Assistant Examiner*—Arnold W. Kramer
*Attorney, Agent, or Firm*—Jack W. Hayden

[57] ABSTRACT

An artificial ski surface construction includes a support surface having an energy absorbing base of elastomer thereon. A flexible sheath covers the energy absorbing base and includes a continuous surface having a fabric underside to contact the sheath with fibers extending upwardly therefrom to provide an artificial ski surface. A structure positions the support surface to form a slope and the continuous surface forms an endless belt which is mounted on rollers with motor means to rotate the rollers and move the continuous surface relative to the sheath and elastomer base.

1 Claim, 2 Drawing Figures

MOVING ARTIFICIAL SKI SURFACE CONSTRUCTION

SUMMARY OF THE INVENTION

Various means have been proposed to simulate a ski surface either for practice skiing or as a training aid in teaching skiing. The present invention provides a relatively simple construction which quite effectively simulates a natural skiing surface to enable a beginner to learn how to ski as well as providing a surface so that an accomplished skier can practice thereon.

Other objects and advantages of the present invention will become more readily apparent from a consideration of the following description and drawings.

DESCRIPTION OF THE PREFERRED EMBODIMENT

Figure 1:
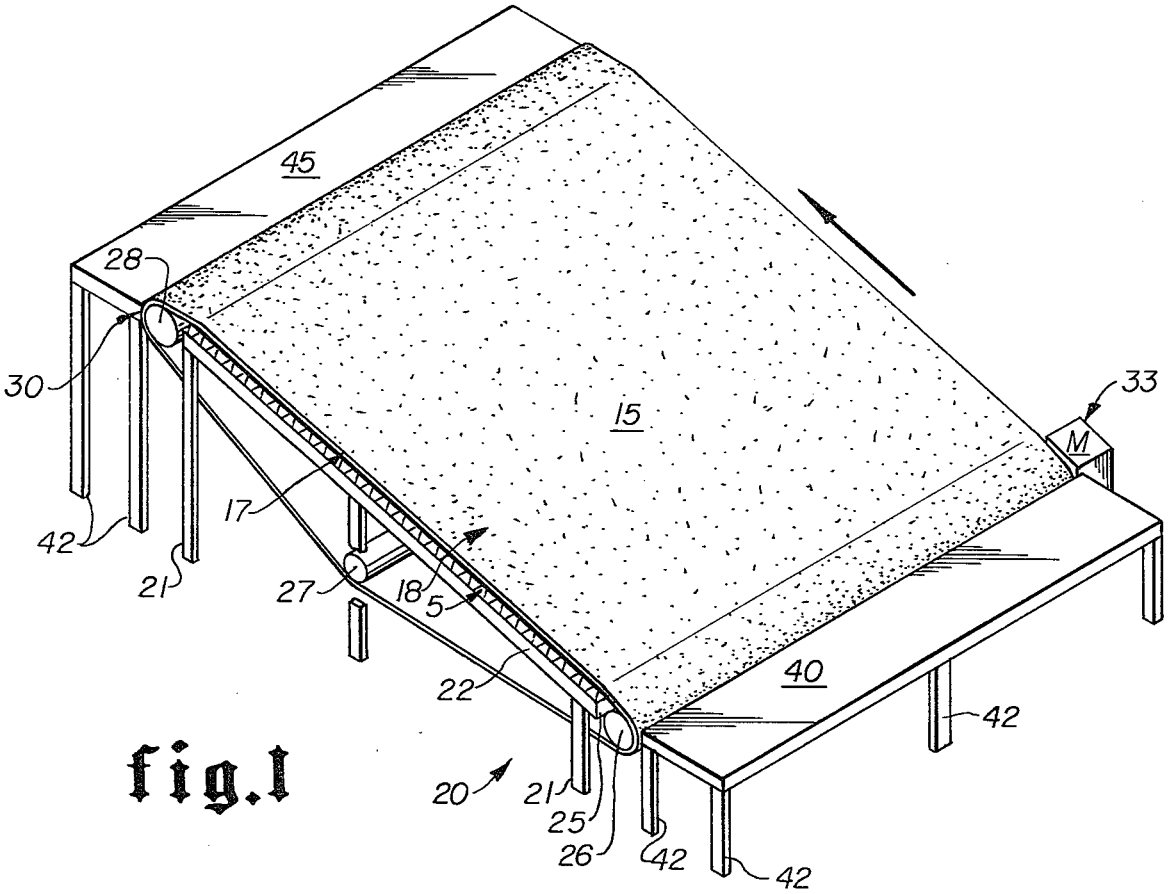
FIG. 1 is an elevational view illustrating the present invention positioned ready for use.
Figure 2:
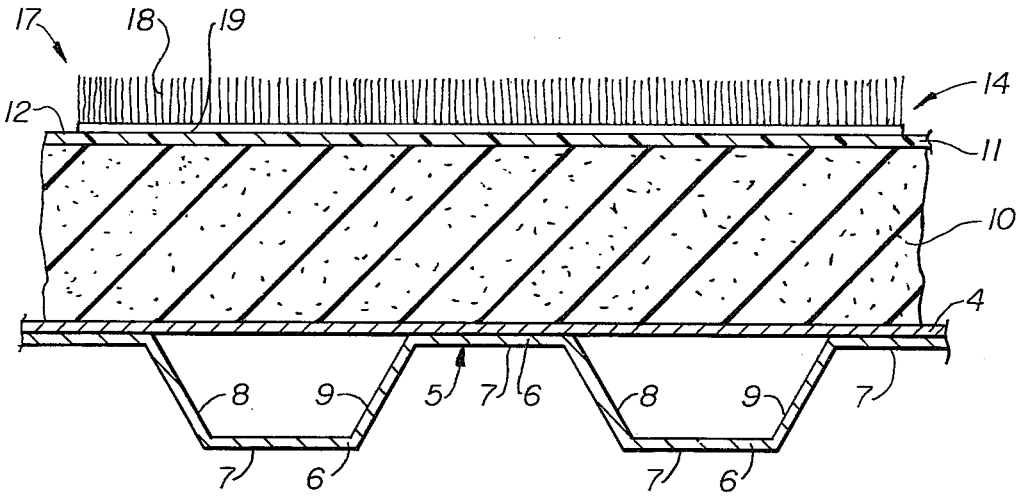
FIG. 2 is an enlarged sectional view illustrating the detailed construction of the present invention.

In FIG. 2 the details of the artificial ski surface are illustrated in enlarged sectional view and the invention is shown as including a support surface referred to generally at 5 which is formed preferably of corrugated metal wherein the corrugations illustrated at 6 include the spaced flat portions 7 which are joined by the sloping side 8 and 9. It will be noted that the corrugations extend laterally of the overall ski surface construction as referred to generally by the numeral 15 in FIG. 1 and is covered by a thin layer of sheet metal 4 to provide a continuous support for the remainder of the artificial ski surface during use when one or more persons are supported thereon.

Suitable means are provided as referred to generally at 20 to position the artificial ski surface 15 on a slope of a desired angle as shown in FIG. 1, such means 20 including the vertical supports 21 which are secured to the frame 22 in which the metal support surface 5 is carried. It will be noted that the vertical supports 21 are shorter at the lower, forward end 25 of the artificial ski surface 15 than at the elevated, rear end 30 of the artificial ski surface 15 to provide a slope or inclined surface of desired angle.

Mounted on the support surface 5 is an energy absorbing base of elastomer 10, which elastomer may be, for example, and is preferably foam rubber. It will also be noted that the foam rubber base is of substantial thickness and preferably at least a minimum of three to four times as thick as the remainder of the artificial ski surface supported thereon. A flexible membrane 11 is mounted adjacent the upper surface of foam rubber base 10 such membrane 11 being continuous throughout the longitudinal and lateral extent of the artificial ski surface 15 and may be formed of either metal, fabric or plastic to provide a continuous surface 12 for accommodating movement of that portion of the artificial ski surface referred to at 14. The membrane 11 may be secured to the base 10 in any suitable manner or it may be fixed in position by securing to base 5 to retain it adjacent the base 10. The lower surface of the elastomer 10 is carried on the sheet metal layer 4.

The portion 14 of the artificial ski surface 15 comprises a continuous surface referred to generally at 17 with fibers 18, such as by way of example only, the artificial or natural fibers of the nap of a rug, which face upwardly from a fabric base or underside 19 secured with the fibers 18. The fabric base is preferably of canvas or any other suitable fabric or plastic material which is continuous and smooth throughout the longitudinal and lateral extent of the continuous surface of material 17. It will be noted that the continuous surface 17 is in the form of an endless belt as shown in FIG. 1 and is movably supported on the longitudinally extending rollers 26, 27 and 28 that are carried by the means 20 in any suitable manner. A suitable power source 33 such as a motor is provided for imparting rotation to one or more of the rollers to move the endless, continuous surface 17 relative to the membrane 11 and the energy absorbing base 10 arranged on the support surface 5.

Thus, when the continuous surface 17 is moved relative to the energy absorbing base 10 and membrane 11, one or more persons with skis can stand on the fibers 18 of the moving continuous surface 17 and this will simulate a natural skiing surface. The continuous surface 17 moves from the lower end 25 towards the upper end 30 of support 5 and the people on the ski surface 15 face the lower end 25 as the continuous surface 17 moves upwardly beneath their skis. It can be appreciated that the length of the vertical supports 21 can be adjusted to provide a desired incline of the artificial ski surface 15 during use.

A safety surface 40 at the lower end 25 of the artificial ski surface 15 and a safety surface 45 at the upper end thereof are provided and may be formed of any suitable material to serve as a means for catching or receiving anyone who may fall on the surface and may move either downwardly therealong, or upwardly by reason of the movement of the continuous surface 17 from the lower front end 25 of the artificial ski surface 15 to the upper elevated rear end 30.

The surface 12 of the thin metal, fabric or plastic membrane 11 is continuous and provides a smooth, uninterrupted surface that causes little frictional resistance to the fabric 19 as the continuous surface 17, of which the fabric 19 is the base or nether surface moves thereover. Also, the fabric 19 is continuous and uninterrupted so that when the fabric 19 and surface 12 are engaged due to the weight of a person on the fibers 18 of the continuous surface 17 anywhere on the sloped artificial ski surface 15, a minimum of frictional resistance is present. Also, since the surface 12 and the surface of fabric 19 are smooth, no abrupt surface variations will cause the skis of a user to move in a manner to cause the skier to fall. The elastomer base 10 absorbs the shock of impact if a skier should fall and inhibits injury.

The safety surfaces 40 and 45 are provided with supports 42 to enable them to maintain their respective positions at the upper and lower end of the sloped artificial ski surface 15.

The foregoing disclosure and description of the invention are illustrative and explanatory thereof, and various changes in the size, shape, and materials as well as in the details of the illustrated construction may be made without departing from the spirit of the invention.

What is claimed is:

1. In an artificial ski surface construction wherein the ski surface is supported at an angle to form a slope and wherein power means are provided to move the artificial ski surface along the slope, the invention including:

a. a continuous support surface;

b. an energy absorbing base of elastomer covering said continuous support surface and having an upper surface;

c. a flexible membrane extending continuously longitudinally and laterally over the upper surface of said elastomer base;

d. a movable, continuous surface including a fabric underside to contact said continuous membrane as the continuous surface is moved thereover, and said continuous surface having fibers extending upwardly from the fabric to provide an artificial ski surface; and e. said energy absorbing elastomer base being of substantially greater thickness than the combined thickness of said flexible continuous membrane and movable continuous surface.

* * * * *